US007224914B2

(12) United States Patent
Ushiroji et al.

(10) Patent No.: US 7,224,914 B2
(45) Date of Patent: May 29, 2007

(54) IMAGE FORMING APPARATUS HAVING A MOVABLE TONER CONTAINER

(75) Inventors: Takahiko Ushiroji, Hino (JP); Toshiro Iwabuchi, Sagamihara (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 11/235,161

(22) Filed: Sep. 27, 2005

(65) Prior Publication Data

US 2006/0159472 A1 Jul. 20, 2006

(30) Foreign Application Priority Data

Jan. 14, 2005 (JP) ..... 2005-007539

(51) Int. Cl.
*G03G 15/08* (2006.01)

(52) U.S. Cl. ..... 399/27; 399/120

(58) Field of Classification Search ..... 399/27
See application file for complete search history.

(56) References Cited

U.S. PATENT DOCUMENTS 4,920,381 A * 4/1990 Mahoney ..... 399/258
5,101,228 A * 3/1992 Nishikawa et al. ..... 399/35
5,260,755 A * 11/1993 Imaizumi ..... 399/35
6,246,841 B1 * 6/2001 Merrifield et al. ..... 399/27
6,571,071 B2 * 5/2003 Kanoshima et al. ..... 399/79
2003/0219263 A1 * 11/2003 Tsuzuki ..... 399/27
2006/0101650 A1 * 5/2006 Matsunai ..... 399/27

* cited by examiner

*Primary Examiner*—David M. Gray
*Assistant Examiner*—Bryan Ready
(74) *Attorney, Agent, or Firm*—Finnegan, Henderson, Farabow, Garrett & Dunner, L.L.P.

(57) ABSTRACT

There is described an image forming apparatus comprising a toner container installation section for mounting a toner container which stores the toner, a developing device which develops an electrostatic images formed on an image carrier based on an image information, an operating mechanism which is capable of moving the toner container from a mounting position in the toner container installation section in a predetermined direction when the toner stored in the toner container is not more than a first predetermined amount, and a movement detecting device which detects the movement of the toner container caused by the operating mechanism and outputs movement information.

7 Claims, 7 Drawing Sheets

LAMP DISPLAY

PATTERN DISPLAY

IMAGE FORMING APPARATUS HAVING A MOVABLE TONER CONTAINER

BACKGROUND OF THE INVENTION

This invention relates to an image forming apparatus such as a copier, printer, facsimile and the like. In particular, this invention relates to an electrophotographic image forming apparatus in which an image is formed by using toner to develop an electrostatic image which is formed on an image carrier.

In the electrophotographic image forming apparatus in which the image is formed by using toner to develop an electrostatic image that is formed on an image carrier thus making the image visible, the developing device must always be replenished with the necessary amount of toner in order to avoid formation of image with a low toner density due to insufficient toner amounts.

One example of recent methods for replenishing is one in which the toner is stored in a bottle-shaped toner container called a toner cartridge which is removable from the image forming apparatus, and the image forming apparatus is equipped with a detecting device for detecting the amount of toner remaining in the toner container. Also, there are some image forming apparatuses that are equipped with a door for replacing the toner container, and when the remaining toner amount detecting device detects that a small amount of toner is remaining, toner replenishing can be performed by easily replacing the toner container with a new toner container at any time without stopping the image formation operation.

Examples of the toner detecting device include one in which a light emitting element and a light receiving element are disposed so as to face each other in a toner container that is formed from a transparent material in order to directly detect the remaining amount of toner that is stored in the toner container. The remaining toner amount is then detected based on the output value from the light receiving element which received light emitted from the light emitting element.

However, this type of remaining amount detecting method has the following problem. In the case of the type of device where the toner container must be rotated in order to replenish the developing device with the toner stored in the toner container, the transparent portion of the toner container becomes stained with toner and it becomes impossible to properly detect the remaining amount of toner and errors in detection often occurs.

Thus, in order to solve this type of problem, the technology of Patent Document 1 for example, has been disclosed. In this technology, a sensor is provided which detects the density of the toner in the pattern formed on the photoreceptor, and if the output from the sensor exceeds a reference value, a determination is made that there is no toner, and the "replenish toner" display flashes and at the same time, the copying operation is stopped. The toner container is then replaced and the reset button is set to ON such the copier can once again be operated.

Also Patent Document 2 discloses technology in which an antenna which is a conductivity detecting member is disposed parallel to the development sleeve in the vicinity of the development sleeve, and by measuring the changes in the amount of toner between the development sleeve and the antenna, or in other words, the applied voltage F during use, with the applied voltage F0 at the time when there is no toner as a reference, the remaining amount of toner G during use is detected.

In addition, technology in which the remaining amount of toner is detected using a remaining amount detection sensor provided inside the toner hopper is disclosed in Patent Document 3.

[Patent Document 1] Japanese Non-examined Patent Publication No. 8-160732

[Patent Document 2] Japanese Non-examined Patent Publication No. 9-114225

[Patent Document 3] Japanese Non-examined Patent Publication No. 2003-66706

However, the technology of Patent Document 1 has a problem in that, because it is a device that detects the density of the toner of the pattern formed on the photoreceptor, when a detection is made that the toner density is low, there is already no toner stored in the toner container, and because of the extreme insufficiency of the toner in the developing device, an image having low toner density is formed. In addition, after the toner container has been replaced, the reset button must be turned on, and thus there is also the problem that operation is complex.

In Patent Document 2, because the technology is a device which detects the induced current inside the developing device, and detects whether the toner amount allows sufficient toner density to be obtained, there is a problem in that when a detection is made that the amount of toner in the developing device is insufficient, an image with a low toner density has already been formed. In addition there are problems in that the induced current detection system causes the structure of the apparatus to be complex and a special circuit is required in order to calculate the remaining amount.

Also, the technology of Patent Document 3 is a device which detects toner amount in the toner hopper, when detection is made that the toner amount in the toner hopper is small, there is already no toner stored in the toner container, and there is the problem that images with extrem toner density are formed.

That is to say, detection of remaining amount of toner in the Patent Documents 1 to 3 can be done without being affected by stains in the toner container, but they do not directly detect the amount of toner stored in the toner container. As a result, in each case, there is a problem in that when the detection is made that the amount of toner remaining is not sufficient, the toner container is already empty and images are formed in which the toner density is low. In some cases even if the toner is replenished immediately, there is the problem that time for restarting the developing device is required for obtaining an image in which the toner density is stabilized.

SUMMARY OF THE INVENTION

The present invention is an image forming apparatus having the structure described below.

An image forming apparatus comprising:

a toner container installation section for mounting a toner container which stores the toner;

a developing device which develops an electrostatic images formed on an image carrier based on an image information;

an operating mechanism which is capable of moving the toner container from a mounting position in the toner container installation section in a predetermined direction when the toner stored in the toner container is not more than a first predetermined amount; and a movement detecting device which detects the movement of the toner container caused by the operating mechanism and outputs movement information.

DETAILED DESCRIPTION OF THE PREFERRED EMBODIMENTS

The present invention will be described in detail with reference to the drawings, but this invention is not to be limited by this embodiment. It is to be noted that the same numbers are assigned to same parts in each drawings and a detailed description will be provided with reference to the other drawings as appropriate.

The image forming apparatus of the embodiment that is described in this invention is an electrophotographic copier for the sake of simplicity. The electrophotographic copier is well known and thus only a simple description will be provided of those parts that are not directly related to this invention.

Figure 1:
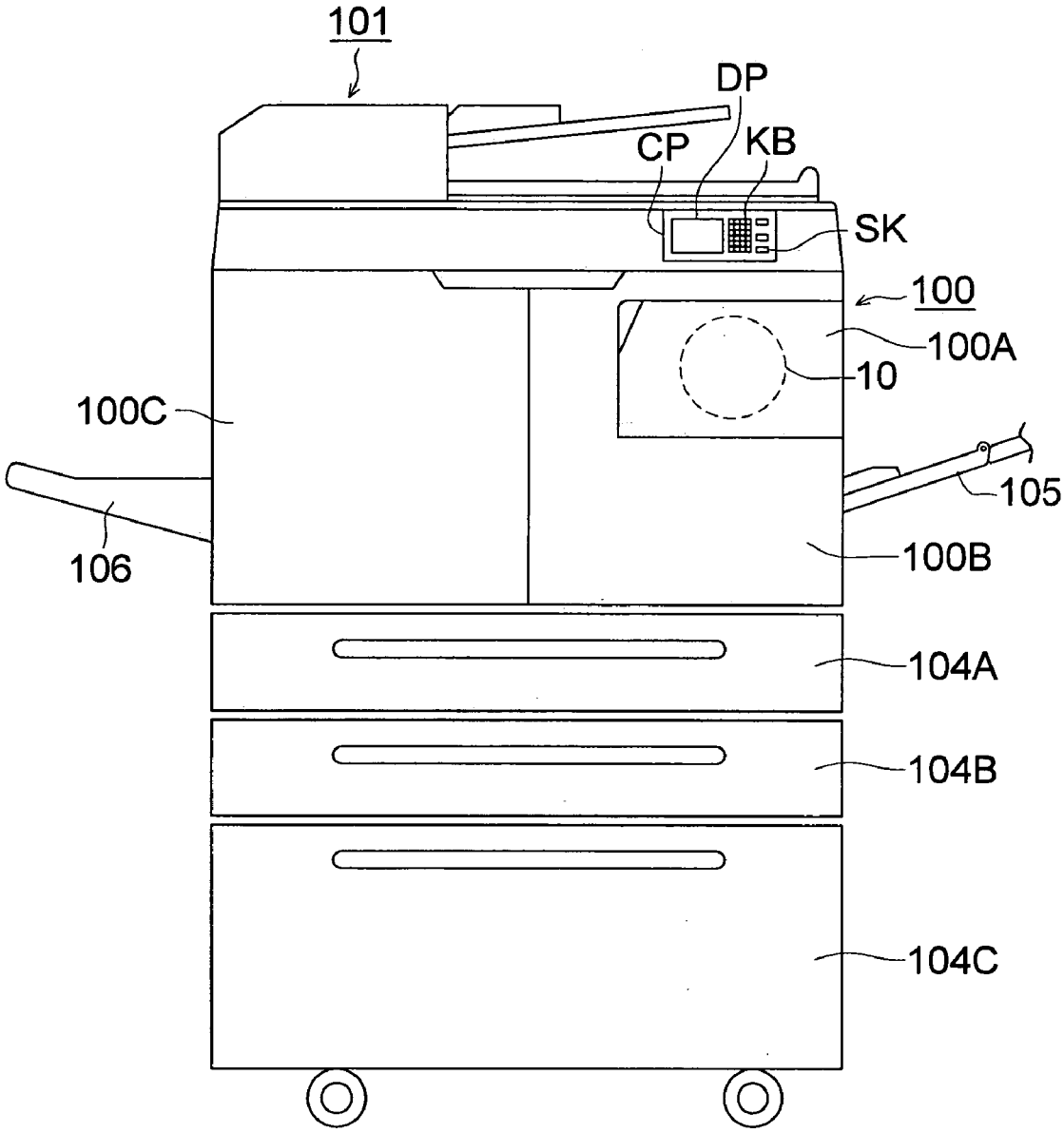
FIG. 1 is a schematic diagram of the image forming apparatus of this invention FIG. 2(*a*) and FIG. 2(*b*) each is a schematic diagram showing mounting of the toner container in the image forming apparatus of this invention.

The structure of the image forming apparatus of this invention will be described using FIG. 1.

The image forming apparatus 100 comprises a manual feed tray 105 at the right side when facing the front and a paper discharge tray 106 at the left side. A control panel CP is provided at the upper side as a display device and operation input means for operating the image forming apparatus 100. The transfer paper (also called recording paper) storage sections 104A, 104B and 104C are provided at the lower side. In addition, an automatic document feeder (ADF) 101 is at the top portion of the image forming apparatus 100.

The control panel CP has a liquid crystal display device as the display device (DP), or alternatively it may have touch panel type liquid display device in which a touch panel or the like is incorporated into a liquid crystal display device.

In this embodiment, the liquid crystal display device which is the display device DP shows a half display or an empty display indicating that the toner amount stored in the toner container is at the half level or that the toner container is empty, or alternatively shows an initial stored amount display (also called full display) indicating the toner container has been replaced. These displays are done using letters or symbols or patterns or the like.

Also, a keyboard KB for inputting values for inputting various image forming conditions such as whether the copy (also called print) is to be in color or black and white or for inputting control related information such as the number of copies and the number of sets, as well as an input device as an operation input means comprising a start button (also called copy button) SK for executing a series of image forming operations such as copying and the like.

In particular, in the touch panel type display device DP, when the user touches the pattern or the like of the buttons displayed in the display section on which numbers, letters, symbols and the like are written, the user may input the selection or setting for the information displayed in the display section. For example, the display device DP has input means for operation mode options which must be selected, such as the one-side mode in which images are formed by transfer to only one side of the transfer paper P or the double-side mode in which images are formed on both sides of the transfer paper.

100A is a door for toner container replacement which opens and closes as a dedicated door for mounting the toner container (also called the toner cartridge) when the toner is being replenished. The door for toner container replacement 100A can open and close independently of other doors. When the door for toner container replacement 100A opens and closes, door opening and closing for toner container replacement information is output by the replacement switch (not shown) which is the door opening and closing detector.

In this embodiment, the toner container 10 is installed at the right upper portion when the image forming apparatus is viewed from the front and has the shape of a long cylinder. The toner container 10 is stored in the image forming apparatus 100 parallel to the side surface of the image forming apparatus 100.

100B and 100C are doors which can, for example, open towards both sides from the center so that the inside of the apparatus can be inspected and prepared for image formation. When door 100B or 100C is opened, the door switch (not shown) is actuated and door switch opening and closing information is output and the image forming apparatus 100 is stopped. When the door 100B is opened, the door for toner container replacement opens together with it.

However, in the case where the door for toner container replacement 100A is opened independently, the image forming apparatus 100 does not stop. The determination as to whether the door for toner container replacement 100A was opened independently is made according to whether information on door opening and closing for toner container replacement only is output or whether information on door opening and closing for toner container replacement is output together with door switch opening and closing information. Accordingly, when the door for toner container replacement 100A is opened independently and the toner container 10 is removed, the operation of the image forming apparatus 100 is not stopped and thus toner can be replenished or in other words the toner container 10 can be replaced without interrupting the image forming operation.

The inside of the doors 100B and 100C will not be described in detail, but they include various means such as an electrical circuit as a controller for image formation using an electrophotographic method, an image carrier and a charging means as well as an image forming means including an exposure means and a developing device, a transfer and separation means, a fixing means and a paper feeding and conveyance means.

The controller is also called a control circuit and is a means for controlling all the operations of the image forming apparatus 100 and is formed of an electrical circuit comprising a CPU (Central Processing Unit) and the like. In addition, control of and driving of the means comprising the image forming apparatus 100 is based on the control programs and control data stored in advance in the CPU.

In addition, in the case where the image forming apparatus 100 has attached devices such as an ADF 101 or the like connected thereto, the controller controls operation in a similar manner such that the image forming apparatus 100 works together with these attached devices and the entire image forming apparatus system runs smoothly.

Figure 2:
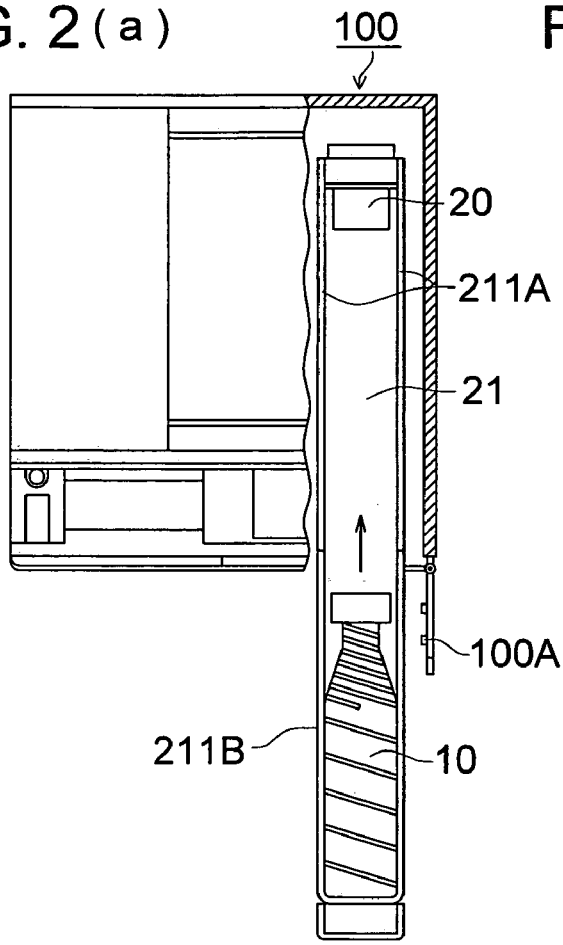
Figure 2:
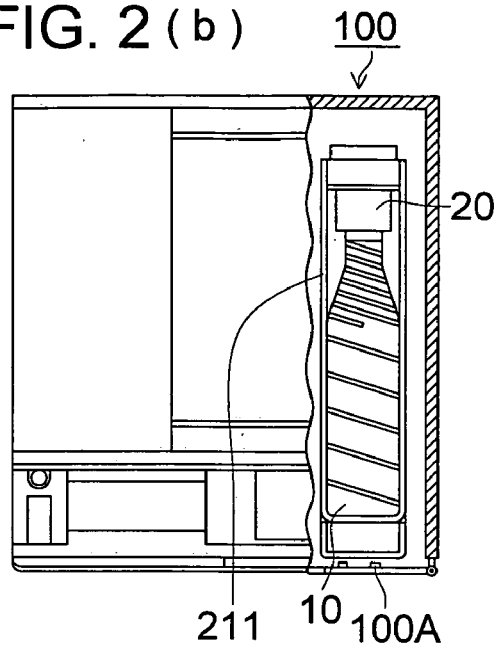

Installation of the toner container in the image forming apparatus is described using FIG. 2(*a*) and FIG. 2(*b*).

FIG. 2(*a*) shows the state where the container receiving portion 21 is pulled out, while FIG. 2(*b*) shows the state where the container receiving portion 21 is stored in the image forming apparatus.

When the toner container 10 is being replaced, first, as shown in FIG. 2(*a*), the door for toner container replacement 100A is opened and the container receiving portion 21 in which the toner container is stored is pulled out, and the toner container which is empty or in which a small amount of toner remains is cut from the installation section 20 which is the toner container installation section and then removed. Next, a new toner container 10 is stored in the container receiving portion 21, and as shown in FIG. 2(*b*), the container receiving portion 21 is returned to its original position and installed into the installation section 20, and the series of replacement operations is completed by closing the door for toner container replacement 100A.

The toner container 10 which is installed in the installation section 20 is rotated in a predetermined direction based on a preset toner replenishing program, and the toner inside the toner container 10 is suitably supplied to the hopper (not shown) of the development container.

It is to be noted that the toner discharge port (not shown) for toner replenishing that is provided in the toner container 10 automatically opens when the toner container 10 is installed in the installation section 20, and it automatically closes when the toner container 10 is pulled out from the installation section 20. In addition, the container receiving portion 21 is provided so as to be movable to the pull out position shown in FIG. 2(*a*) and the storing position shown in FIG. 2(*b*) using the slide rail 211 which comprises a fixed rail 211A and a moving rail 211B.

Figure 3:
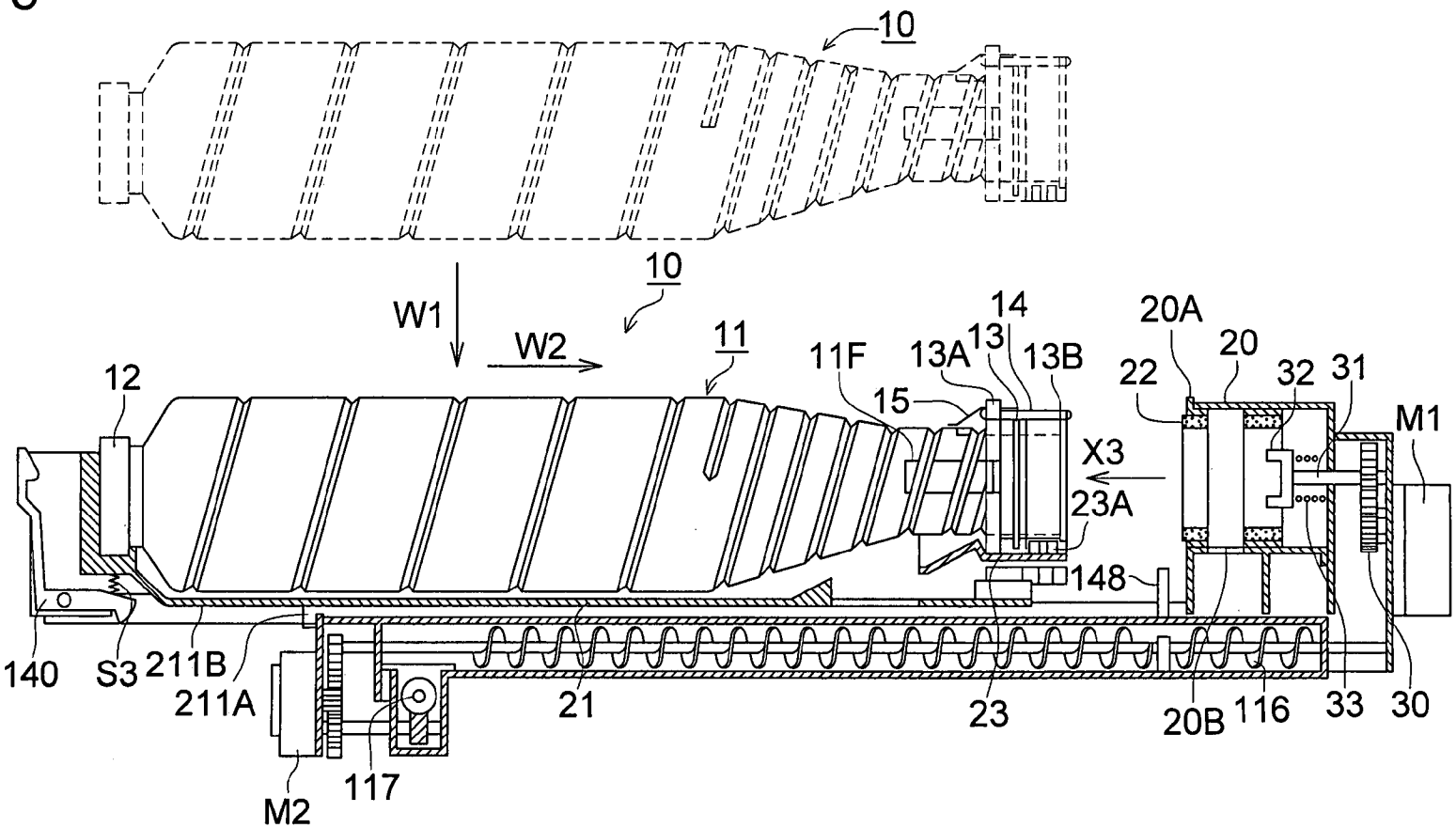
FIG. 3 is a schematic diagram showing the state in which the toner container is installed in the image forming apparatus of this invention.

Installation of the toner container will be described using FIG. 3.

The toner container 10 comprises the container main body 11, the fixing cap 12, the opening member 13, the sealing member 14, the adhesive tape 15 and the like. The new toner container 10 which is shown by the dotted line is dropped into the container receiving portion 21 as shown by the arrow W1 and then the container receiving portion 21 is moved as shown by the arrow W2, and the toner container 10 is installed to the installation section 20 by being coupled with the installation section 20.

When the toner container 10 is installed to the installation section 20, the opening member 13 is moving with respect to the container main body 11, and the sealing member 14 is peeled off and the toner discharge port is open. This type of movement of the opening member 13 is carried out by pushing the rim 13B onto the attachment opening 20A which is opening member operating mechanism of the installation section 20. 22 is the sealing member which is formed of sponge which seals the inserted toner container. It is to be noted that the opening member operating mechanism may be configured such that the opening member is moved by acting on the opening member receiving portion 23 via the opening member receiving portion 23. When the toner container 10 is installed in the installation section 20, the male couplings 31 and 32 of the installation section 20 and the female couplings of the toner container 10 are in a state in which they may be engaged, and when the male coupling 32 is rotated by the motor M1, both engage due to the action of the spring 33. The toner container is rotated and driven by the motor M1 via the drive system 30 and the couplings 31 and 32. When the toner container 10 is being installed, a distinction is made between the types of toner container which use the rim 13B. For example, in the case where a toner container which is different from that to be installed at the installation section 20 because the toner color is incorrect or the like, the rim 13B does not align with the projection 23A which is provided at the opening member receiving portion 23, and thus only the correct toner container can be installed.

The toner container is driven so as to rotate by the motor M1, and the toner is conveyed to the toner discharge port by a spiral projection (not shown). The toner which flows from the toner discharge port is dropped from the dropping opening 20B which is provided at the installation section 20 and conveyed by the toner replenishing device which comprises the conveying screws 116 and 117, and then fed to the developing device (not shown). The conveying screws 116 and 117 are driven by the motor M2.

The remaining toner amount detection device which is stored in the toner container will be described using FIG. 4.

Figure 4:
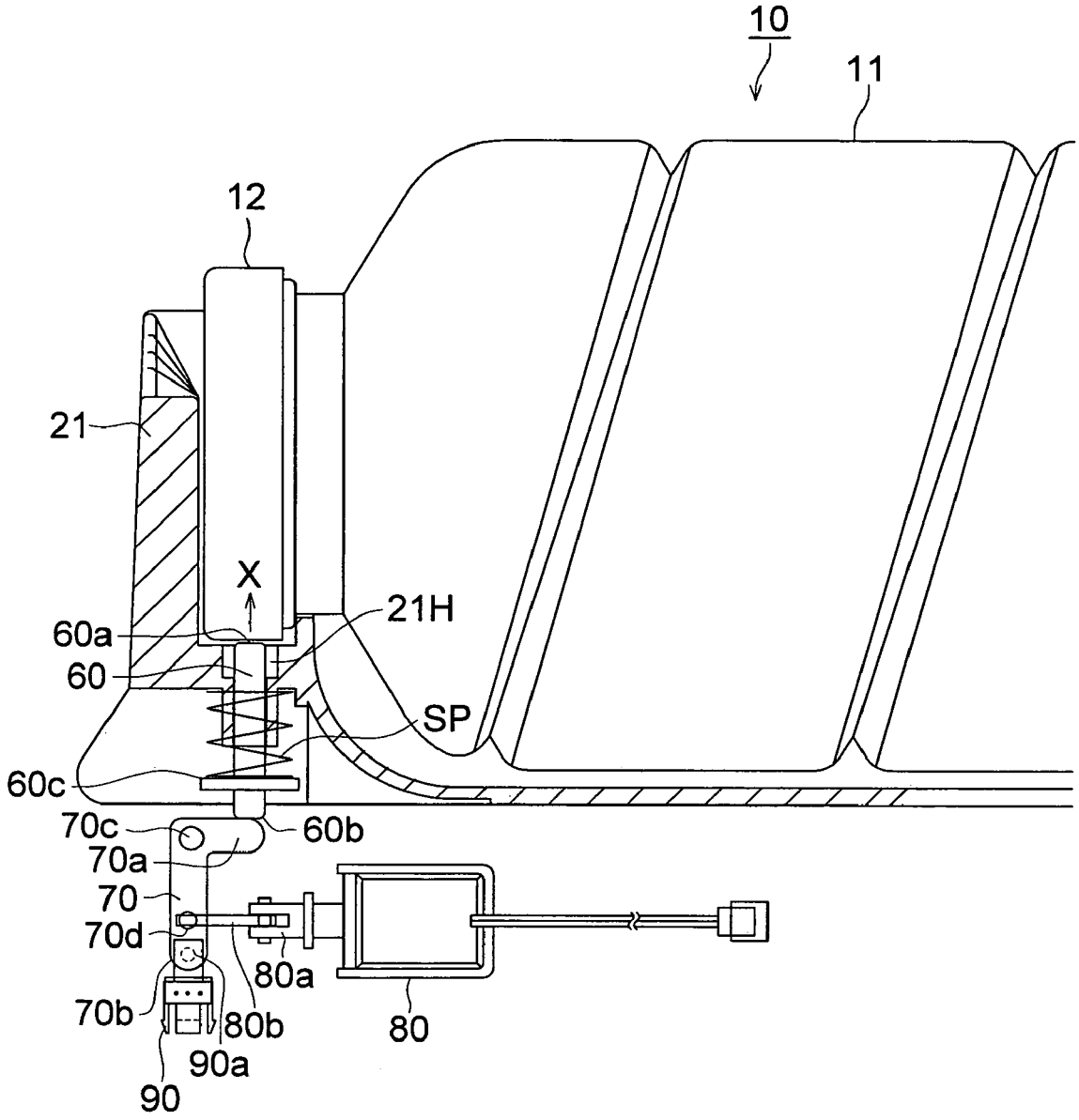
FIG. 4 is a pattern diagram showing the remaining toner amount detecting device of this invention.

FIG. 4 shows the state in which the toner container 10 is installed on the container receiving portion 21 and thus installed at the installation section 20. 11 is the container main body. 12 is the fixing cap.

The remaining toner amount detection device of this embodiment comprises an operating mechanism and a movement detecting device, and the operating mechanism comprises mainly an operating member 60, a coil spring SP, a moving lever 70, and a driving member 80 and the like. The movement detecting device is configured as the movement detection sensor 90.

The container receiving portion 21 has a hole 21H which penetrates the position opposing the fixing cap 12 of the toner container 10 when the toner container 10 is installed and the operating member 60 fits into the hole 21H.

The operating member 60 has the shape of a rod having a polygon-shaped cross-section including that of a circle, and the rim portion 60*c* is at the lower portion. In addition, the front end 60*a* of the operating member 60 separates the small space between the toner container 10 and the fixing cap 12 and is provided so as to make contact during operation, while the rear end 60*b* of the operating member 60 contacts the moving lever 70. The operating member 60 is urged so as to be normally positioned at the moving lever 70 side as a result of the coil spring SP engaging with the rim portion 60*c* of the operating member 60.

The moving lever 70 has a first arm 70*a* and a second arm 70*b*, and can rotate in the anticlockwise direction about the rotation shaft 70*c*. The first arm 70*a* contacts the rear end 60*b* of the operating member 60 and at the time of operation, the operating member 60 moves in the direction of the arrow X, while the second arm 70*b* has a hole 70*d* with which the connection lever 80*b* which is connected to the driving member 80 engages.

The second arm 70*b* is usually at a position which opposes the movement detection sensor 90 (the initial position in the drawing), and when the driving member 80 is actuated and the operating member 60 moves, the second arm 70*b* moves in the anticlockwise direction from the position opposing the movement detection sensor 90, and thus the movement detection sensor 90 can output movement information.

In this embodiment, the driving member 80 is a plunger which is an electromagnetic driving device in which the driving force can be adjusted by the amount of the voltage or the current supplied. It comprises an adjustable shaft 80*a* which moves towards the right of the position in the drawing when the current is supplied and a connection lever 80*b* which engages with the adjustable shaft 80*a* and the hole 70*d* which is in the moving lever 70.

It is to noted that, in the case, for example, where detection is done when the amount of toner stored in the toner container 10 is reduced to half, it is necessary to adjust the balance between the urging force of the coil spring SP and the driving force (tension) of the adjustable shaft 80*a* of the driving member 80 such that the operating member 60 can lift up and move the fixing cap 12 portion of the toner container 10 when the amount of toner stored in advance in the toner container 10 is reduced to half.

The movement detection sensor 90 is formed, for example, of a photo-coupler comprising a light emitting portion and a light-receiving portion, and when the second arm 70*b* of the moving lever 70 moves from the initial position toward the position 90*a* which opposes the light-emitting portion and the light-receiving portion, the light emitted from the light emitting portion is received by the light-receiving portion and movement information is output.

Detection of the remaining amount of toner stored in the toner container will be described in the following.

Detection of the remaining amount of toner stored in the toner container 10 is preformed for example, when the power of the image forming apparatus 100 is turned ON or when one job is complete, given that one job is defined as the image forming operations based on one set of image information, or when image formation is performed on a predetermined number of sheets, or alternatively at preset remaining toner amount detection times such as when the door for toner container replacement 100A opens and closes.

When it is time for detecting the remaining toner amount, an electric current of a fixed amount is supplied to the driving member 80 by a control circuit (not shown) which is the controller described hereinafter. When the toner stored in the toner container 10 is reduced to half, the adjustable shaft 80*a* of the driving member 80 rotates the moving lever 70 in the anticlockwise direction from the initial position shown in FIG. 4 via the connecting lever 80*b*. The first arm 70*a* of the moving lever 70 resists the urging force of the coil spring SP and pushes up the rear end 60*b* of the operating member 60 and the front end 60*a* of the operating member 60 pushes up the fixing cap 12 of the toner container 12.

When the operating member 60 pushes up the toner container 10 and moves in the direction of arrow X, the second arm 70*b* of the moving lever 70 rotates in the anticlockwise direction and thus, the light emitted from the light emitting portion is received by the light-receiving portion at the movement detection sensor 90 and movement information is output.

Next, when the current being sent to the driving member 80 is turned OFF, the operating member 60 returns to its initial position due to the urging force of the coil spring SP, and the toner container 10 is returned to its original position. After this operation, the moving lever 70 rotates in the anticlockwise direction and the adjustable shaft 80*a* of the driving member 80 returns to the initial position via the connecting lever 80*b*. The detection of the remaining amount of toner stored in the toner container 10 is complete with this set of operations.

In the case where the amount of toner stored in the toner container 10 is not reduced to half, the operating member 60 cannot lift up the toner container 10 and thus the moving lever 70 also is unable to rotate in the anticlockwise direction and the movement detection sensor 90 is unable to output movement information.

It is to be noted that this invention detects lifting of the toner container and detects that the amount of toner stored in the toner container is not more than a predetermined amount.

In this embodiment in particular, detection is done when the amount of toner stored in the toner container is reduced to half. However, this invention is not to be limited by this embodiment, and by adjusting the coil spring SP or the drive force of the adjustable shaft 80*a* of the driving member 80, the operating member 60 can be moved when a predetermined amount is reached, and the detection may be done when the toner amount is not more than a predetermined amount.

Also, in this embodiment, a structure using a plunger is used as the driving member in the configuration for lifting the toner container, but this invention is not limited to this example. Similarly, the movement detecting device is not limited to a photo-coupler.

In addition, the number of location for detection is not limited to one, and for example, the drive force of the adjustable shaft 80*a* of the driving member 80 may be set to a plurality of levels and a plurality of movement detection sensors 90 may be provided and thus the reduction in the amount of toner stored in the toner container 10 can be gradually detected.

Figure 5:
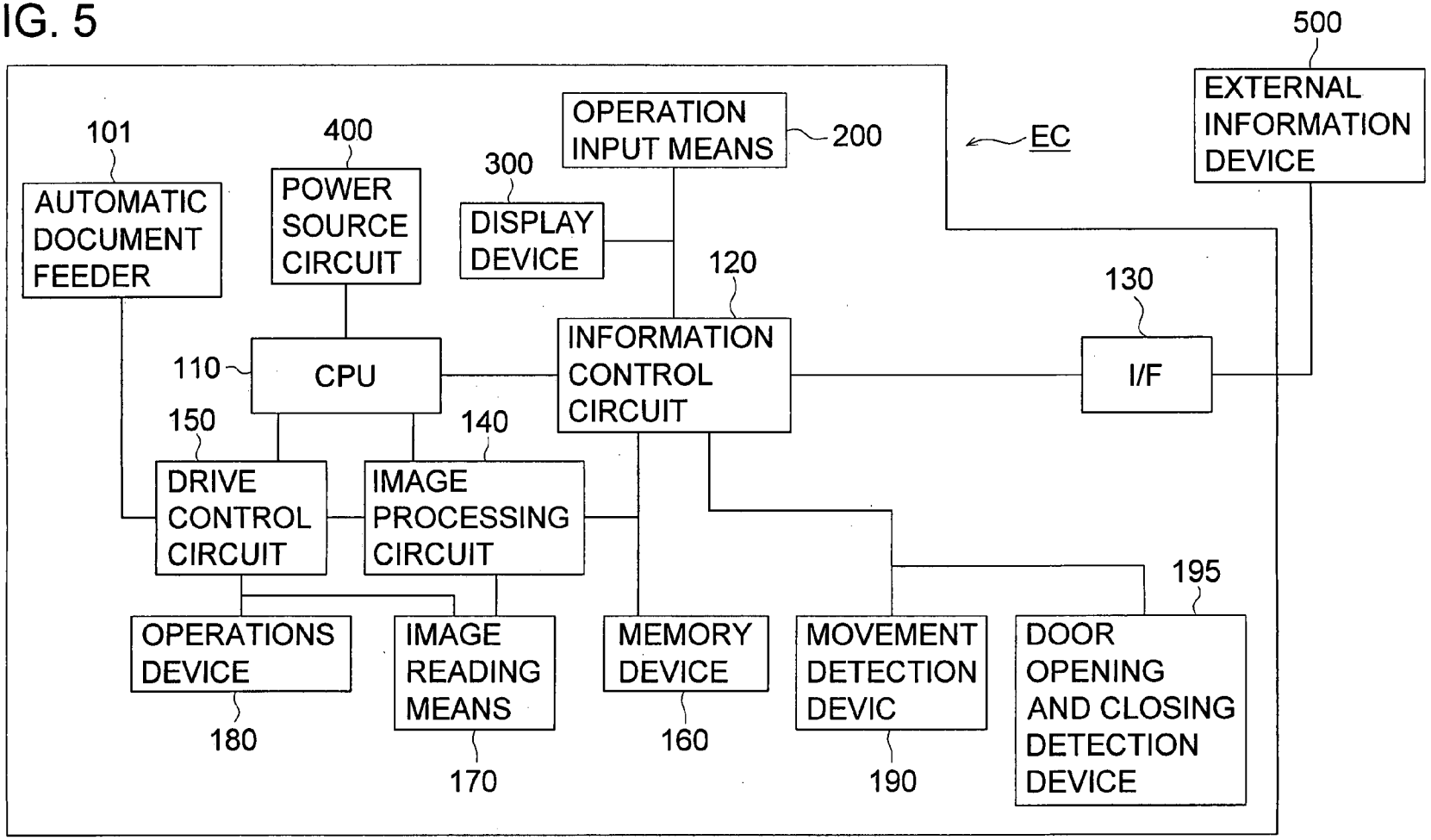
FIG. 5 is block diagram showing the circuit configuration of the image forming apparatus of this invention.

Next, the circuit configuration of the image forming apparatus in this embodiment will be described using FIG. 5. It is to be noted that in this embodiment, the case where the image forming apparatus is a copier is described.

EC shows the configuration of all the means and circuits of the image forming apparatus 100. 110 is a CPU which controls the entire image forming apparatus, it stores in advance, the various modes programs or data necessary for executing the programs for controlling the image forming apparatus 100.

The information control circuit 120, the image processing circuit 140, the drive control circuit 150 and the power source circuit 400 and the like are connected to the CPU 110. In addition, a controller having the CPU 110 and these circuits can perform overall control of the image forming apparatus 100.

The information control circuit 120 connects with external information devices via the interface (I/F) 130 based on instructions from the CPU 110. Image information such as text and images or setting information such density required for image formation or magnification and the like is input and stored in the memory device 160. In addition, the setting information stored in the memory device are output to the image processing circuit 140, the drive control circuit 150 or the display device 300.

The information control circuit 120 determines job information composed of the image information input from the external information device 500 and the setting information and the like. In addition, the information control circuit 120 determines various types of information input by the operation input means 200 or the information indicating the operation status which is output during operation of the various means which are examples of information pertaining to circuits including the image processing circuit 140, the drive control circuit 150 and the like and instruction information required for operation of the various means. The information control circuit 120 also has the function of smoothly transmitting information to the circuits and the various means in the image forming apparatus such that there are no hindrances in the operation of the image forming apparatus.

The external information device 500 is generally a computer or an internet server, but in some cases it may be another image forming apparatus on a local area network (LAN) or a digital camera or an information device such as measuring device which is capable of outputting measured information.

It is to be noted that in this embodiment, when the information control circuit 120 opens and closes the door for toner container replacement 100A, the door opening and closing for toner container replacement information which is output by the replacement switch which is the door opening and closing detector is stored in the memory device 160, and when the door 100B or 100C opens the door switch is actuated and the outputted door switch opening and closing information is also stored in the memory device 160.

In addition, the information control circuit 120 shows a half display at the display device 300 which indicates that the amount of toner stored in the toner container 10 has been reduced to half, based on the movement information output from the movement detecting device 190.

However, with only the movement information output from the movement detecting device, a determination can only be made that the toner stored in the toner container has been reduced to half and the empty state of the container cannot be detected. This is not convenient when the user wishes to know the status between the half level and when the container becomes empty. For example even if the half display is on, if the user wishes to copy a document urgently, the user will be unable to ascertain whether the document can be copied without replacing the toner container 10.

That is to say, even though the half display is shown, there is still a problem in that there is no empty display indicating that the toner container is empty, or no full display indicating that the toner container 10 has been replaced.

As a result, for example, attention is placed on the fact that the toner container 10 is rotated in order to replenish the developing device with the toner stored in the toner container 10, and the information control circuit 120 is caused to function as a counting means for counting the number of rotations, and the number of rotations can be counted from the point where a determination is made that the toner container 10 has been replaced by a new one.

The number of rotations for the toner container 10 is determined by the approximate number of rotations that are done from the state where the initial storage amount of toner stored in the new toner container (full state) until the state where the container is empty using experiments and the like. In this embodiment, the number of rotations at the half level is set to Y/2 while the number of rotations at the empty level is set to Y.

Thus, if the number of rotations X (count value) which is counted by the summation method exceeds Y/2 (setting value), the information control circuit 120 determines that the amount of toner stored in the toner container 10 has been reduced to half, and if it exceeds Y (setting value), a determination is made that the toner container 10 is empty.

In other words, in this embodiment, at the time of detection of the amount of the toner stored in the toner container 10, the remaining amount can be more accurately detected and displayed by the information control circuit 120 using the determination based on the count value of the number of rotations of the toner container 10 and the movement information which is detected by actually lifting the toner container 10, and thus toner replacement can be done more quickly and this prevents the occurrence of image defects due to extremely reduced toner density.

In addition, because the information control circuit 120 detects whether the toner container 10 has actually been replaced, after the movement information is output from the movement detecting device, if there is door opening and closing information for toner container replacement is output from the door opening and closing detector, a determination is made that the toner container 10 has been replaced with a new container and the count value and the like are reset.

It is to be noted that in this embodiment, for the sake of simplicity, the setting value for the predetermined amount which is the number of rotations is Y/2 (first predetermined amount) when the toner container is at the "half", and the number or rotations is Y (second predetermined amount) when the toner container is "empty". However, the invention is not limited to this embodiment and, setting values such as (⅔) Y and (¾) Y and the like which are between Y/2 and Y, may be appropriately set as the desired predetermined amount. The gradual reduction in the toner level may be displayed using symbols or warning displays in stages using text and the like such as "Toner amount is at the half level", "Get ready to replace the toner container", "Replace toner container", "Out of toner" or "Replace toner container immediately".

In this embodiment, the number of rotations of the toner container is counted, but any information pertaining to the amount of toner that is used may be applied. For example, the number of image formation operations performed on an A4 size transfer paper using the toner stored in one toner container may be counted as a reference number and the average number of general image formation operations is determined in advance by experimentation. The half value (setting value) where the toner amount is reduced to half and the empty value where the toner container is empty (setting value) may then be set as the setting values which will be the reference values.

In addition, this number of image formation operations may be the corresponding number of images on the A4 size transfer paper that are formed on the image carrier of the image forming means and the number of rotations of the image carrier, or the corresponding number of images of the A4 size transfer paper on which development is done by the developing means and the number of rotations or the like. Also, it is needless to say that the number of copies of one side of the A4 size transfer paper may be counted as the number of image forming operations. Of course, the size used for the reference is not limited to A4, and the size may be suitably selected.

In this embodiment, the count value is counted using the summation method in which the frequency is increased from 1 time to 2 times etc., but it is needless to say that the reduction method may also be used.

Interface (I/F) 130 is an information receiving means and is configured such that it can be connected via the respective network to the aforementioned external information device 500 such as a computer, another image forming apparatus or internet server or the like.

The image processing circuit 140 digitizes the image information from the document that is read by the image reading means (not shown) based on the instructions from the CPU 110 and stores this as image data in the memory device 160. The image processing circuit 140 is a circuit which performs conversion to data and signals and the like which are suitable for the image forming method of the image forming means 20 when the image forming method 20 forms images based on the image data that is stored in the memory device 160.

The drive control circuit 150 works together with the image processing circuit 140 based on instructions from the CPU 110, and it drives the image forming means 170 which comprises: a charging means for evenly charging the photoreceptor drum or the like which is the image carrier; an exposure means which performs exposure based on the image information; a developing device which converts the electrostatic image formed in the carrier to a toner image using toner thereby making the image visible, a transfer and separation means which transfers the toner image to the transfer paper; a fixing means which fixes the transferred toner image onto transfer paper; a cleaning means for cleaning the image carrier; and a feed and discharge conveying means for feeding and discharging the transfer paper.

It is to be noted that in this embodiment, for example, when the power source for the image forming apparatus 100 is turned ON, or when one job is complete, given that one job is defined as the image forming operations based on one set of image information, or when image formation is performed on a predetermined number of sheets is performed, or alternatively preset remaining toner amount detection times for toner stored in the toner container such as when the door for toner container replacement 100A opens and closes, the operating mechanism 180 is actuated by instructions from the CPU 110 and detection of the remaining amount of toner stored in the container 10 is carried out.

The movement detecting device 190 comprises a photocoupler including a light emitting portion and a light-receiving portion, and when the moving lever 70 moves from the initial position, the light emitted from the light emitting portion is received by the light-receiving portion and movement information is output.

In this embodiment, the door opening and closing detection device 195 comprises a replacement switch which is actuated when the door for toner container replacement 100A opens and closes and a door switch which is actuated when the door 100B or 100C opens. When the replacement switch is actuated, door opening and closing for container replacement information is output, and when the door switch is actuated, door switch opening and closing information is output and both types of information are stored in the memory device 160 via the information control circuit 120.

The operation input means 200 is an input device which is provided on the control panel CP of the image formation device 100. Examples may include the touch panel type liquid crystal device (DP) which is a display device, the keyboard KB, the start button SK and the like.

For example, setting information for the transfer material (also called transfer paper), such as the number of sheets to be output or the type of output (such as index paper, thick paper, normal paper, thin paper, recycled paper, OHP sheets) or the percentage for enlarging or reducing or the density of the output images may be input by operating the keyboard KB.

In addition, the operation input means 200 may function as an input means for setting various modes for the image forming apparatus 100 such as the color mode and black and white mode or the single side and double side mode which are selectively selected when a copy operation is performed.

The display device 300 comprises the foregoing liquid crystal display device or a display device DP which has a touch panel incorporated into the liquid crystal display section.

The display device 300 displays a list of the operation sequence and various kinds of information when information is input using the operation input means 200. It may also display information stored in the memory device 160 and status displays or warning displays during the operation of the image forming apparatus 100.

It is to be noted that in this embodiment, detailed descriptions will be omitted, but by selectively setting the display method using the control panel CP, the half display, the empty display and the full display (also called initial stored amount display) are displayed as the remaining amount display for the toner stored in the toner container 10 at the liquid crystal display device. Alternatively, text displays with text such as "Get ready to replace toner container" and the like may be displayed or design displays using symbols, patterns or the like may be shown. Furthermore, warning displays may be shown by flashing or switching off the liquid crystal display, or alternatively, by flashing or switching off a lamp that is separately provided.

The automatic document feeder (ADF) 101 works together with the-drive control circuit 150 in response to the operation of the start button SK based on instructions from the CPU 110 of the image forming apparatus 100.

The memory device 160 stores information job information or job data relating to job information which comprise the image data and the setting conditions and the like for controlling the image forming apparatus 100 which are required for image formation, as well as information for programs and the like for the various modes.

In this embodiment, the memory device stores the door opening and closing for toner container replacement information in particular, which indicates that the door for toner container replacement 100A has been opened and closed, and the door switch opening and closing information which indicates that the door 100B or 100C has been opened.

Of course, it is needless to say that separate storage means may be provided depending on the type of information to be stored.

When the power switch is turned ON by the user, the power source circuit 400 supplies suitable current from the power source to the image forming apparatus main body, and when the power source switch is turned OFF, the current supply is turned OFF.

It is to be noted that the configuration may be such that when the power source is turned OFF using the power source switch, as is the case with the power saving mode in which the image forming apparatus is put on standby, all the power sources are not turned off, but rather only the amount of current required for operating the CPU 110 and the like is supplied, and when the power switch is turned ON or when image information is input via a LAN, the image formation operations can begin immediately.

In addition, in this embodiment, when the moving lever 70 moves from the initial position, movement information is output. However, the invention is not to be limited by this embodiment, and for example, a sensor may be disposed above the toner container, and when movement of the container is detected by the sensor, movement information is output.

Figure 6:
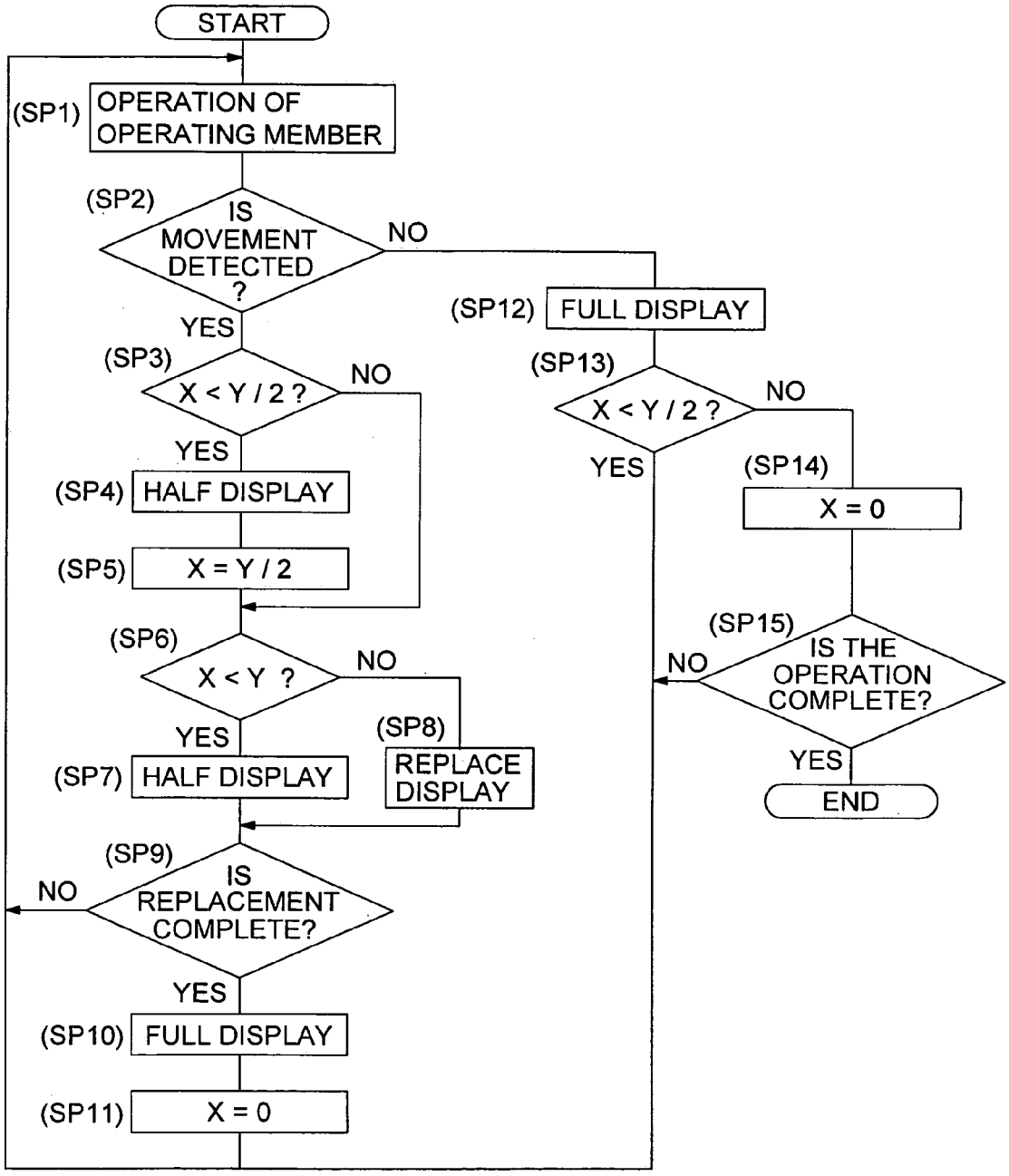
FIG. 6 is a flowchart for describing the remaining toner amount detection control process of this invention.

Next, the control sequence for detecting the remaining amount of toner stored in the toner container is described using FIG. 6.

It is assumed that when amount of toner stored in the toner container is reduced to half, the movement detection sensor 90 outputs movement information. In addition, the information control circuit 120 counts the rotations of the toner container 10 using the summation method, and the setting value when toner stored in the toner container 10 is reduced to half is Y/2, while the setting value when the toner container is empty is Y.

(SP1)

This is the step for operating the operating member. The operating member is automatically operated at the time for remaining toner amount detection by a program which is setup in advance at the CPU 110 of the control circuit. When it is time for the detection of the remaining toner amount, current is supplied to the driving member 80 of the operating mechanism 180 via the drive control circuit 150 as a result of instructions from the CPU 110 of the control circuit and the operating member 60 is thereby actuated and the operation proceeds to Step SP2.

(SP2)

This is the step in which a determination is made as to whether the operating member has moved. If the movement detection sensor 90 which is the movement detecting device 190 detects that the operating member 60 has moved and movement information is output, the operation proceeds to Step SP3, while if movement information is not output, the operation proceeds to Step SP12.

(SP3)

This is the step in which a determination is made as to whether the count value X is less than the setting value Y/2. The information control circuit 120 counts the number of rotations of the toner container 10 from the time that a new toner container is replaced using the summation method.

Thus, because the movement information is output from the movement detecting device 190, it is expected that the count value X is more than the setting value Y/2, but if the count value X is not more than the setting value Y/2, this indicates that discrepancy in the output timing of the movement information and count value X. If nothing is done to correct this discrepancy, the timing for toner container replacement will be too late, and there is the risk that images will be formed with extremely little toner density, and thus the operation proceeds to Step SP4 to correct the discrepancy. When the count value X becomes more than the setting value Y/2, the information control circuit 120 continues to count and proceeds to SP6.

(SP4)

This step is for performing the half display at the display device. The information control circuit 120 proceeds to SP5 in which the half display is shown at the display device 300 to indicate that the amount of toner stored in the toner container 10 has been reduced to half.

(SP5)

This step is for setting the count value X to the setting value Y/2. Because there was a discrepancy between the output timing of the movement information and the count value X, the information control circuit 120 sets the count value X to the setting value Y/2, and counting is resumed and the operation proceeds to SP6.

That is to say, in this embodiment, when the operating member 60 lifts the toner container 10, the movement detecting device 190 outputs movement information which indicates that the amount of toner stored in the toner container 10 has been reduced to half, and thus there may be variations in the output timing of the movement information due to variations in the setting of the drive force for driving the operating member 60 and the operation status of the operating member 60.

In addition, the setting value Y/2 and Y are set based on the total number of rotations obtained in advance by experiments that are done from the state where the initial storage amount of toner is stored in the new toner container (full state) until the state where the container is empty, and thus the output timing of the movement information and the setting value Y/2 as well as the setting value Y and empty state always match.

Thus, as is the case in this embodiment, if the relationship between toner amount reduction and the operation of the operating member 60 or the count value. X are to be matched to the greatest extent possible, correction in the discrepancy will be necessary. However if an accuracy level in which an approximate determination can be made is sufficient, matching may not be necessary and thus this step may be unnecessary.

(SP6)

This is the step in which a determination is made as to whether the count value X is not more than the setting value Y. Because the movement information has already been output, it is known for sure that the count value X is more than the setting value Y/2 and a determination is made as to whether the value is more than Y, or in other words if the toner container 10 is empty.

The count value X is not more than the setting value Y, the toner container is not empty and thus the operation proceeds to SP7, while if the count value X is more than the setting value Y, the toner container is empty and thus the operation proceeds to SP8.

(SP7)

This is the step in which the half display is shown. Because the count value X is more than the setting value Y/2, and not more than the setting value Y, the information control circuit 120 shows the half display at the display device 300 which indicates that the amount of toner stored in the toner container has been reduced to half and continues counting and the operation proceeds to SP9.

(SP8)

This is the step in which the replace display is shown. Because the count value X is more than the setting value Y, the information control circuit 120 shows the replace display in the display device 300 which recommends replacement of the toner container using, for example, the empty display which indicates that the toner container is empty and then the operation proceeds to SP9.

(SP9)

This is the step in which a determination is made as to whether toner container replacement is complete. In this embodiment, in order to detect whether the toner container has actually been replaced, the information control circuit 120 determines that the toner container 10 has been replaced with a new one in the case where door opening and closing for toner container replacement information is output from the door opening and closing detection device 195 after the movement information has been output from the movement detecting device 190 and the operation returns to SP10. On the other hand, in the case where door opening and closing for toner container replacement information is not output, a determination is made that the toner container 10 has not been replaced and the operation returns to SP1 to wait for the time for the next remaining toner amount detection.

It is to be noted that in this embodiment, in some cases, after the half display is shown, the user may replace the toner container just to be safe, and thus after the half display is shown, a detection can be made at any time as to whether the toner container has been replaced.

(SP10)

This is the step in which full (initial stored amount) display is shown. The information control circuit 120 determines that the toner container 10 has been replaced with a new one and thus the "full" display which indicates that the toner container 10 is full is shown by the display device 300, and the operation proceeds to SP11.

It is to be noted that in this embodiment, the new toner container of course refers to a toner container that has never been opened, but it also refers to a toner container which is not new, but has been replenished and essentially has the initial stored amount of toner. It also refers to a toner container in which the toner amount is more than the half and close to initial stored amount. In other words, new toner container refers to any container for which movement information has not been output.

(SP11)

This step sets the count value X to 0. The information control circuit 120 sets the count value X to 0, or in other words, the count value X is reset and new counting begins for the new toner container and the operation returns to SP1.

It is to be noted that in the case where a determination is made that the toner container 10 has been replaced, if there is need to reset the count value as was the case for the count value X, it is preferable that resetting is done in this step.

(SP12)

This is the step in which the full display is shown. The information control circuit 120 has detected that the movement detecting device 190 has not output movement detection information and thus the full display which indicates that the toner container is full is shown at the display device 300 and the counting continues and the operation proceeds to SP13.

(SP13)

This is the step which determines whether the count value X is not more than the setting value Y/2. In the case where the movement detecting device 190 has not output movement information and the count value X is not more than the setting value Y/2, the information control circuit 120 determines that the amount of toner stored in the toner container is still sufficient and the full display continues to be shown and the operation returns to SP1.

In addition, if the movement detecting device 190 has not output movement information and the count value X is more than the setting value Y/2, in this embodiment, if for example the power source of the image forming apparatus is turned off for repairs and the like, the toner container will be considered to be a new one, and the information control circuit 120 proceeds to SP14 in order to reset the count value X.

In other words, when the power supply is turned off, movement information and door opening and closing for toner container replacement information are not output, and also this information is not stored in the memory device 160. Thus, if the information control circuit 120 is unable to determine whether the toner container has been replaced based on this information; a determination that the toner container has been replaced is made in this step.

(SP14)

This is the step in which the count value X is set to 0. Because a determination is made that the toner container has been replaced by a new one, the count value X is set to 0. In other words, the count value X is reset and new counting is started for the new toner container 10 and the operation proceeds to SP15.

It is to be noted that in the same manner as SP11, if a determination is made that the toner container 10 has been replaced, if there is need to reset the count value as was the case for the count value X, it is preferable that resetting is done in this step.

(SP15)

This step determines whether detection of the remaining amount of toner stored in the toner container has ended. Usually, the detection is continuing and thus the operation proceeds to SP1. If, for some reason, the detection of the remaining toner amount is to be ended, the detection can be ended, for example, by setting it to end at the control panel CP.

It is to be noted that after the detection of the remaining amount of toner is set to end at the control panel CP, when setting is to be done for the toner remaining amount detection is to be executed again, it is necessary to set the remaining amount detection to start at the control panel CP.

Figure 7:
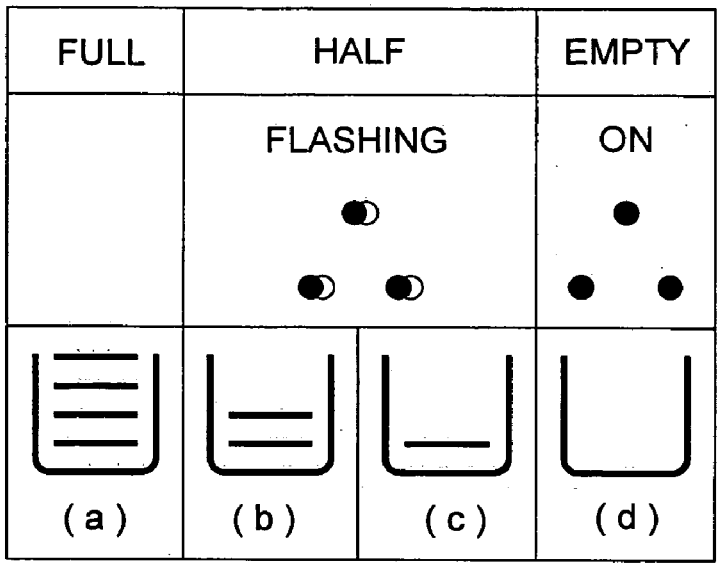
FIG. 7 is a pattern diagram for describing the remaining toner amount display of this invention.

A simple description of the displays in FIG. 7 follows.

The display methods for displaying the remaining amount of toner stored in the toner container is largely divided into three types which are: (A) lamp display; (B) pattern display and (C) text display.

In the case of (A), the lamp display a LED or the like is used for example, and for the full display, the lamp may be kept off, for the half display, the lamp flashes and preparation to replace the toner container is recommended; and for the empty display, the light is kept on and toner container replacement is requested.

In the case of (B), a liquid crystal display may be used and, for example, reduction in the amount of toner is shown by decrease in the number of horizontal lines which represent the remaining toner amount. The full display is shown in (a) with four horizontal lines, the half display is shown in (b) with two horizontal lines, and in (c) there is one horizontal line and thus the number of lines is gradually decreased and toner replacement recommended. In the case of the empty display (d), no horizontal lines are shown to represent the empty state and toner container replacement is requested.

No drawings are shown for (C) in which text display is done, but a liquid crystal display and the like may be used for example, and the full display may read "Full" or the "The toner container is full."; the half display may read "The amount of toner has reduced to half." or "Prepare to replace toner container."; while the empty display may read "Replace toner container" or "Out of toner" or "Replace toner container immediately."

It is to be noted that for the empty display, a separate buzzer device may be provided in order to request replacement of the toner container, and a warning sound generated with the warning of the three types of displays (A)–(C).

It is to be noted that in addition to the liquid crystal display device and the like of the display device 300, the toner remaining amount display preferably adopts a pattern display in which the remaining toner amount is displayed in stages, and reduction beyond a predetermined amount is easily confirmed.

An embodiment of this invention was described above, and based on this embodiment, in order to detect the remaining amount of toner stored in the toner container, if the amount of toner stored in the container is not more than a predetermined amount, the toner container can be lifted and moved by the operating member and thus by detecting whether the operating member or the toner container has moved. Accordingly, detection can be made that the remaining amount of toner stored in the toner container is not more than a predetermined amount. So, when the toner amount is reduced to half, the half display is shown and the preparation to replace the toner container is recommended.

In addition, after the half display is shown, the information pertaining to the amount of toner that is used, such as the number of times that the toner container is rotated for supplying toner stored in the toner container is counted. When the count value X reaches the setting value Y, determination is made that the amount of toner stored in the toner container exceeds the predetermined amount, or in other words the toner container is empty and the empty display is then shown and the toner container replacement is requested.

In addition, detection of toner container replacement is usually done using the movement information output by the toner remaining amount detection device and the door opening and closing for toner container replacement information which output when opening and closing of the door for toner container replacement such that the toner container may be replaced after the movement information is output is detected. However, in some cases when the current is turned off, the toner container is replaced and in this case, because movement information is not output although the count value X is more than Y/2, determination is made that the toner container has been replaced. Thus the replacement of the toner container can be detected with certainty under any condition, and in the case where it is determined that the toner container has been replaced, the display is changed from the half display or empty display to the full display, and resetting of the count value X is ensured.

That is to say, in this invention, when the toner stored in the toner container becomes no more than a first predetermined amount (such as the half level), the operating member lifts and moves the toner container, and thus by detecting movement of the operating member, the remaining toner amount can be detected without being affected by the staining of the toner container, and thus an image forming apparatus can be provided which is capable of high quality image formation in which the toner density is stable.

In addition, by performing detection by combining the movement information which indicates that the operating member has moved and information pertaining to the amount of toner used such as information on the number of rotations of the toner container, the time when the amount of toner stored in the toner container reaches a second predetermined amount, or in other words the empty state can be displayed. Thus, operational errors such as forgetting or the replacing of the toner container too late can be avoided, and thus an image forming apparatus can be provided which is capable of high quality image formation in which the toner density is always stable.

In addition, after the movement information that indicates that the operating member has moved is output, if the door opening and closing for toner container replacement information which indicates that the door for toner container replacement has been opened and closed is output, a determination is made that the toner container has been replaced, and the display is changed from one indicating that the toner amount is not more than a predetermined amount to a display indicating that the toner container is full. The setting value X is reset and thus by simply replacing the toner container, the user may immediately move to the operations for image formation.

In addition, in the case where a determination is made that the toner container is replaced, because the display at the display device is changed from one indicating that the toner amount is not more than a predetermined amount to a display indicating that the toner container is full, the user may feel comfortable knowing that images having a suitable toner density will be obtained.

In addition, although the image forming apparatus of this embodiment is a copier, it is needless to say that image forming apparatuses such printers and facsimile devices may also be used.

What is claimed is:

1. An image forming apparatus comprising:

a toner container installation section for mounting a toner container capable of storing toner;

a developing device which develops an electrostatic image formed on an image carrier based on an image information;

an operating mechanism which is capable of moving the toner container from a mounting position in the toner container installation section in a predetermined direction when the toner stored in the toner container is not more than a first predetermined amount; and a movement detecting device which detects the movement of the toner container caused by the operating mechanism and outputs movement information.

2. The image forming apparatus of claim 1, wherein the operating mechanism comprises an operating member for moving the toner container and a driving member for operating the operating member, and the movement detecting device detects movement of the operating member and outputs the movement information.

3. The image forming apparatus of claim 1, further comprising:

a controller which receives the movement information; and a display device which indicates that the amount of toner stored in the toner container is not more than the first predetermined amount when the controller receives the movement information.

4. The image forming apparatus of claim 1, further comprising:

a controller which receives the movement information;

a counting device which counts information pertaining to the amount of toner used as a count value, wherein the controller receives the movement information and then determines whether the count value that has been counted by the counting device from the time that the toner container was installed, has reached the setting value which indicates that the amount of toner stored in the toner container is a second predetermined amount.

5. The image forming apparatus of claim 4, wherein the count value obtained by the counting device is the number of rotations of the toner container which rotates in order to replenish the developing device with the toner stored in the toner container or the number of image forming operations in which development is done by the developing device.

6. The image forming apparatus of claim 1, further comprising:

a controller which receives the movement information;

a door for toner container replacement for installing and removing the toner container; and a door opening and closing detector which detects the opening and closing of the door for toner container replacement information; wherein the controller checks the output of the door opening and closing for toner container replacement information after receiving the movement information.

7. The image forming apparatus of claim 1, further comprising:

a controller which receives the movement information;

a display device which indicates that the amount of toner stored in the toner container is not more than the first predetermined amount when the controller receives movement information; wherein the controller changes from a display at the display device indicating that the toner amount is not more than the first predetermined amount to a display indicating that a toner amount is an initial stored amount when the toner container is replaced.

* * * * *